US007195730B2

(12) United States Patent
Calderoni et al.

(10) Patent No.: US 7,195,730 B2
(45) Date of Patent: Mar. 27, 2007

(54) METHOD FOR MAKING CENTRALIZERS FOR CENTRALISING A TIGHT FITTING CASING IN A BOREHOLE

(75) Inventors: Angelo Calderoni, San Donato Milanese-Milan (IT); Fabrizio Zausa, Calvignasco-Milan (IT)

(73) Assignee: ENI S.p.A., Rome (IT)

( * ) Notice: Subject to any disclaimer, the term of this patent is extended or adjusted under 35 U.S.C. 154(b) by 195 days.

(21) Appl. No.: 10/433,414

(22) PCT Filed: Nov. 15, 2001

(86) PCT No.: PCT/EP01/13459

§ 371 (c)(1),
(2), (4) Date: Dec. 18, 2003

(87) PCT Pub. No.: WO02/48501

PCT Pub. Date: Jun. 20, 2002

(65) Prior Publication Data

US 2004/0094308 A1 May 20, 2004

(30) Foreign Application Priority Data

Dec. 15, 2000 (IT) ..... MI2000A2713

(51) Int. Cl.
*B29C 45/14* (2006.01)
*E21B 17/10* (2006.01)

(52) U.S. Cl. ..... 264/279; 166/380; 249/90; 425/195

(58) Field of Classification Search ..... 264/259, 264/279; 425/188, 192 R, 195; 249/90, 249/95, 167, 173; 166/380
See application file for complete search history.

(56) References Cited

U.S. PATENT DOCUMENTS

| | | | | | |
|---|---|---|---|---|---|
| 467,881 | A | * | 1/1892 | Fisher | 249/90 |
| 2,286,716 | A | | 6/1942 | Clark | |
| 2,832,996 | A | * | 5/1958 | Loftis | 249/95 |
| 2,855,643 | A | * | 10/1958 | Ludwig et al. | 164/102 |
| 3,049,382 | A | | 8/1962 | Ell | |
| 3,251,919 | A | * | 5/1966 | Ell | 264/251 |
| 3,718,309 | A | * | 2/1973 | Harris | 249/90 |
| 3,948,575 | A | | 4/1976 | Rosser | |
| 4,088,185 | A | * | 5/1978 | Carson | 166/176 |
| 5,095,981 | A | | 3/1992 | Mikolajczyk | |
| 5,613,556 | A | | 3/1997 | Sable et al. | |
| 5,842,518 | A | * | 12/1998 | Soybel et al. | 166/287 |
| 6,312,637 | B1 | * | 11/2001 | Evans et al. | 264/275 |

FOREIGN PATENT DOCUMENTS

| | | | |
|---|---|---|---|
| GB | 2282615 | * | 4/1995 |
| WO | 97/08422 | * | 3/1997 |

* cited by examiner

*Primary Examiner*—Jill L. Heitbrink
(74) *Attorney, Agent, or Firm*—Oblon, Spivak, McClelland, Maier & Neustadt, P.C.

(57) ABSTRACT

Method for the centralization of drill casings in a tight borehole, both vertical and deviated, comprising the following operations: Application on the casing section in question, of an adherence strip equipped with one or more housings and rapid adjustable lever closure; Insertion of suitable molds in the housings of which the strip is equipped; Injection into the molds of plastic material characterized by a high mechanical resistance, a high degree of surface adhesion and resistance to abrasion by friction, and also in-place elasticity, higher than the elasticity of the casings; Removal of the adherence strip once the hardening of the plastic material in the shape of the mold, has been completed.

3 Claims, 3 Drawing Sheets

METHOD FOR MAKING CENTRALIZERS FOR CENTRALISING A TIGHT FITTING CASING IN A BOREHOLE

CROSS REFERENCE TO RELATED APPLICATIONS

This application is filed under 35 U.S.C. §371 for PCT/EP01/13459, filed Nov. 15, 2001, and is based upon and claims priority under 35 U.S.C. §119 from Italian Patent Application No. MI2000A002713, filed Dec. 15, 2000.

FIELD OF THE INVENTION

The present invention relates to a method for the centralization of drill casings to be used for lean profile applications, which substantially comprises the application of strips of ceramic material onto the outer walls of the casing.

BACKGROUND OF THE INVENTION

During the drilling of oil wells, set casing operations of the hole are effected, which comprise the positioning of specific casings at pre-established intervals in relation to the depth reached and characteristics of the formations penetrated.

When effecting set casing, in order to guarantee an easy lowering of the casings into the well, it is generally necessary to ensure that the difference between the external casing diameter and the hole diameter (clearance) is maintained at sufficiently high values.

During drilling, according to conventional technologies, the clearance between casing and hole can vary from values of about 6–7 inches (15–16 cm) for the surface and/or intermediate phases, up to values close to an inch for the deeper phases (for example: 26" hole for a 20" conductor pipe; 17½" hole for a 13⅜" casing; 12¼" hole for a 9⅝" casing; 8½" hole for a 7" casing).

The necessity of adopting high clearance values is linked to the high rigidity of pipes with a greater diameter/thickness and to the impossibility of drilling perfectly vertical holes and/or with controlled curvature. The poor flexibility, in fact, of the pipes together with a certain degree of irregularity of the hole (deviations, tortuosity and/or squeezing), can make the lowering of the casings into the well problematical, above all during the surface and/or intermediate phases.

The necessity, according to conventional technologies, of effecting holes with a much larger diameter with respect to that of the casing, to guarantee its lowering to the well bottom during the surface and intermediate phases, causes the formation of a considerable quantity of waste products and a lengthy stay time of the plant on the territory, with consequent long drilling times and high costs.

The Applicant is holder of the copending Italian patent application MI 2000A 000007 of May 5, 2000 which relates to an improved method for the drilling of oil wells and contemporaneous positioning of specific casings, characterized by maintaining the clearance more or less constant for the whole well depth desired, which consists in effecting the drilling of the well section of interest, maintaining a high degree of regularity of the hole by the use of automatic equipment for verticality and/or curvature control.

This drilling method allows, with the same diameter of the casing, the dimensions of the upper part of the well (surface and intermediate casings) to be reduced. This enables a substantial reduction in materials (sludge, cement and steel) and consequently in the production of waste products. This technique also avoids the necessity of producing holes with a diameter which is too high with respect to the casings to be positioned, which generally implies the possibility of effecting holes with a lower diameter with respect to the conventional technique. All of this has a positive influence on the advance rate of the chisel bit and therefore allows a reduction in the production times of the holes with a consequent decrease in costs. The technique according to said invention also enables significant savings to be obtained on the operating costs, as the verticality and/or regular curvature of the well facilitates all workover and well intervention operations.

This method comprises a drilling and set casing technique which allows the positioning of casings, operating with a clearance which is more or less constant at values of about 1.5 inches (3–4 cm) for the whole well depth desired. The fact of operating with a reduced clearance allows, with the same number of casings and end-diameter of the casing, the dimensions of the upper part of the well to be significantly reduced.

This solution is particularly suitable for applications in deep, vertical or off-line wells, also in the presence of formations with a low drillability and/or difficulty in trajectory control. In these cases, on adopting the technique described, a considerable saving of time and drilling costs is obtained.

In the drilling method mentioned above, as generally in all lean profile applications, the centralization of the casings, when effected with traditional procedures, is highly critical.

This criticality is due to the lack of physical space necessary for the mechanical installation of centralization systems (reduced spaces corresponding to mechanical fragility).

As the inclination of the hole increases, so does the criticality due to the higher casing/hole wall interference, obviously greater in the hole sections with the presence of more or less severe doglegs.

The absence of centralization of the casing, however, has the following disadvantages:

Increase in the friction factor, with an increase in the wear of the casing and consequent decrease in its resistance properties;

Increase in the risks of the wedging of the casing with the risk of not succeeding in correctly lowering the casing to the bottom;

Unbalance in the flow by-pass area;

Reduction in the quality of cementations by the canalization of cement during displacement.

For conventional (standard) well profiles, these problems are drastically reduced by centralizing the casing.

The centralizing is, in fact, obtained by inserting along the outer surface of the casing, various elastic metallic blades (similar to leaf springs), with an extended diameter comparable to that of the hole, capable of keeping the casing at a distance from the wall and uniformly centred with respect to the hole axis:

This solution cannot however be applied in the case of lean profiles as:

All standard centralizers existing on the market have a blade supporting body and a stop collar for attaching them to the pipe; this increases the overall bulk which excludes their application for systems with reduced diameter clearances;

Centralizers for particular applications, such as for example intracasing centralizers, drastically modify the total rigidity of the casing, which viceversa must be able to maintain a good elasticity (flexibility) for following the geometry of the hole to the utmost.

SUMMARY OF THE INVENTION

The Applicant has now found, according to the object of the present invention, that it is possible to overcome all the known drawbacks in the state of the art by effecting the centralization of drill casings by means of the application of strips of ceramic material on the outer walls of the casings.

The object of the present invention therefore relates to a method for the centralization of casings for applications of the lean profile type, both vertical and off-line, which comprises the following operations:

Application on the casing section in question, of an adherence strip equipped with one or more housings and rapid adjustable lever closure;

Insertion of suitable moulds in the housings of which the strip is equipped;

Injection into the moulds of plastic material characterized by a high mechanical resistance, a high degree of surface adhesion and resistance to abrasion by friction, and also elasticity in place, higher than the elasticity of the casings;

Removal of the adherence strip once the hardening of the plastic material in the shape of the mould, has been completed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1A:
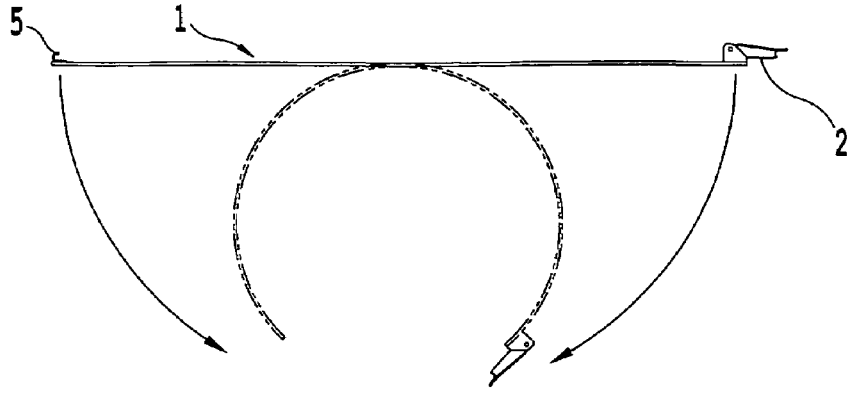
FIG. 1A illustrates a side view of an embodiment of the present invention.

An important advantage of the method described above is the possibility of its being effected directly on site, thus obtaining centralizers whose shape, dimension, number and position can be established a priori, in relation to the operating requirements. The position, length and thickness with which the centralizers are to be produced, can, in fact, be calculated and determined a priori, in relation to the diameter of the casing, the length and inclination angle of the hole section along which the casing is to be lowered.

Once the project characteristics have been defined, the pipes are blasted to obtain a surface capable of ensuring correct adhesion of the resin. At the end of the blasting phase, each pipe 7 is equipped with a specific adhesion strip, obtained using a transparent plate 1 made of plastic material with a high resistance (FIGS. 1A and 1B), having a rapid adjustable lever closure, including a lever 2 and a hook 5, and apertures 6 capable of housing die cast molds 3: FIGS. 2A–2C illustrate an example in which from a minimum of one to a maximum of three die cast molds can be present.

Each mold 3 has a specific injection hole 4, through which the resin compound, obtained by means of an appropriate mixing system between resin and hardener, is poured. The adhesion strip-mold system thus obtained allows, on the one hand, the centralizers to be correctly positioned and distanced, both radially and axially, along the pipe. On the other it guarantees the regular shape of the centralizers, keeping them correctly in position until the binding reaction of the catalyst/resin system has taken place. Once the binding time necessary for the hardening of the centralizers is over, it is possible to remove the adhesion strip and relative die cast shapers.

Figure 1B:
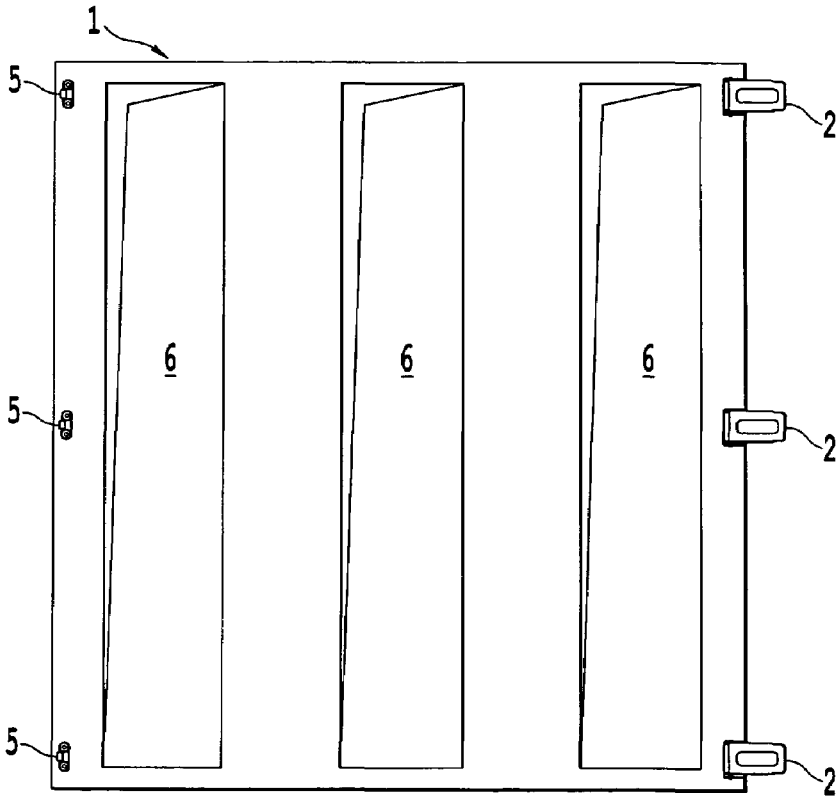
FIG. 1B illustrates a plan view of an embodiment of the present invention.
Figure 2A:
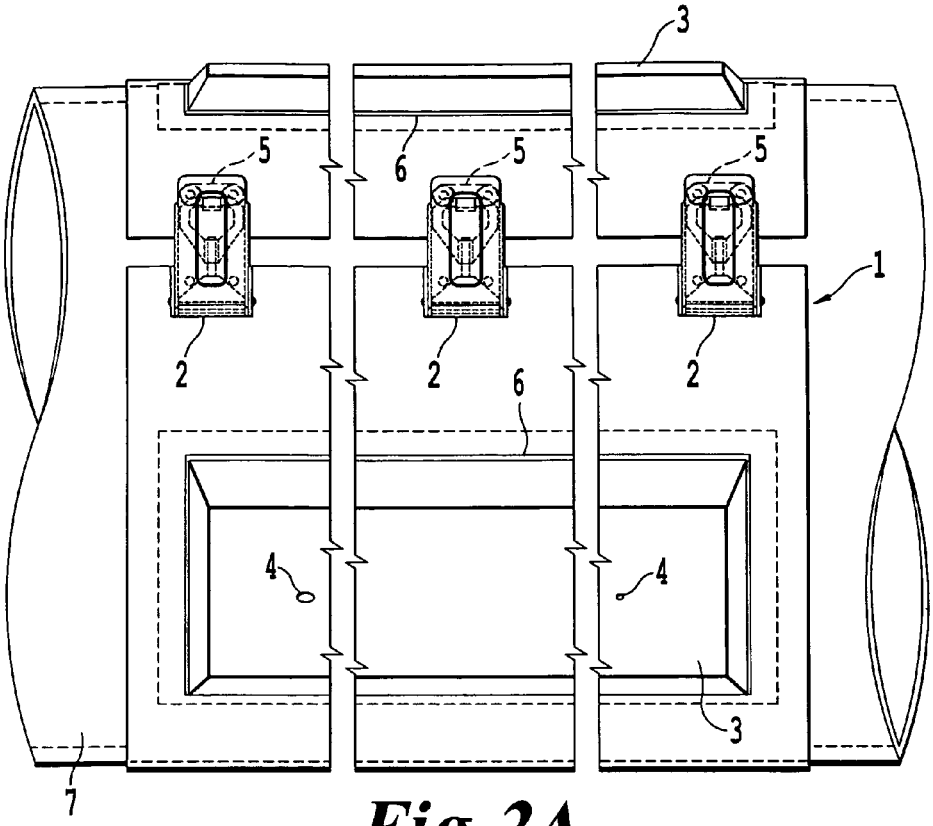
FIG. 2A illustrates a view of an embodiment of the present invention wrapped around a pipe.
Figure 2B:
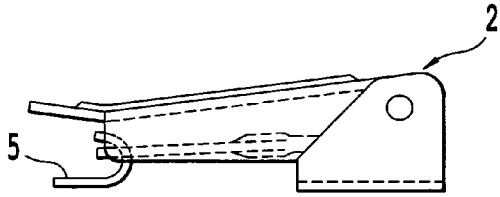
FIG. 2B is a close up side view of an embodiment of a rapid adjustable lever closure.
Figure 2C:
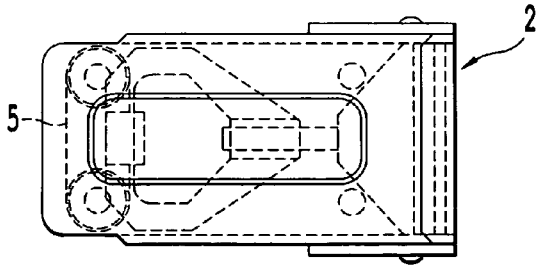
FIG. 2C is a close up pian view of an embodiment of a rapid adjustable lever closure.
Figure 3A:
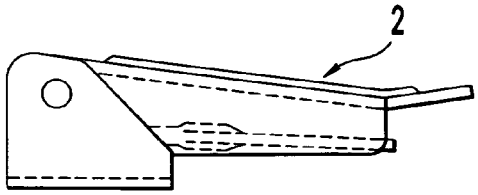
FIG. 3A is a close up side view of an embodiment of an adjustable lever of the rapid adjustable lever closure.
Figure 3B:
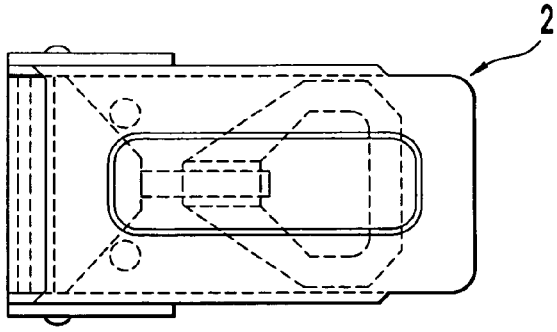
FIG. 3B is a close up plan view of an embodiment of an adjustable lever of the rapid adjustable lever closure.
Figure 3C:
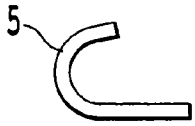
FIG. 3C is a close up side view of an embodiment of a hook of the rapid adjustable lever closure.
Figure 3D:
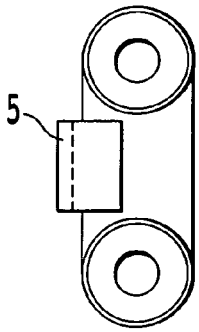
FIG. 3D is a close up plan view of an embodiment of a hook of the rapid adjustable lever closure.

With reference to the figures enclosed with the present invention, which have the sole purpose of illustrating the object according to the present invention, FIGS. 1A and 1B represent a detail of the transparent plate of plastic material in which 2 and 5 represent countersunk bolts forming the rapid closure to be used when the plate is wound around the casing and in which the apertures 6 receiving housings the molds 3 can be observed. FIGS. 2A–2C in turn illustrate the same plate indicating the rapid adjustable lever closures, in FIG. 2B, and in which there is a detail of the same closure, in FIG. 2C. Said closure is also represented in FIGS. 3A–3D, in which FIGS. 3A and 3B represent drawings thereof, for an embodiment of lever 2 in zincated steel, and FIGS. 3C and 3D represent drawings of the hook 5 for the adjustable lever closure.

Confirming the validity of what is specified above with respect to the method for the centralization of casings and the operating steps comprised therein, we would like to stress again that there are two elements which mainly characterize said method:

A compound of resins, characterized by a high mechanical resistance, a high degree of surface adhesion and resistance to abrasion by friction and, finally, elasticity in place higher than the elasticity of the casings.

The production, also directly on site, of centralizers, with the possibility of appropriately varying the shape, dimension, number and position thereof, in relation to the operating requirements.

The resinous material naturally has a primary function; any known material can be suitable for the purpose provided it is characterized by the appropriate qualities: as an example, high resistance epoxy resins can be mentioned.

The invention claimed is:

1. A method for making centralizers for centralization of drill casings for lean profile applications, either vertical or off-line, comprising:

applying on a casing section an adherence strip equipped with one or more housings and rapid adjustable lever closure;

inserting at least one mold in at least one of the housings;

injecting into the at least one mold plastic material having a high mechanical resistance, a high degree of surface adhesion and resistance to abrasion by friction, and also elasticity in place, higher than the elasticity of the casings; and removing the adherence strip once hardening of the plastic material in the shape of the at least one mold is complete.

2. The method for making centralizers for the centralization of drill casings for lean profile applications according to claim 1, wherein the adhesion strip contains a maximum of three housings.

3. The method for making centralizers for the centralization of drill casings for lean profile applications according to claim 1, wherein the plastic material injected into the at least one mold is an epoxy resin.

* * * * *